US008083201B2

(12) United States Patent
Cedrone

(10) Patent No.: US 8,083,201 B2
(45) Date of Patent: Dec. 27, 2011

(54) APPARATUS AND METHOD FOR SUPPORTING AND ALIGNING IMAGING EQUIPMENT ON A WEB CONVERTING MANUFACTURING LINE

(75) Inventor: Louis J. Cedrone, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 412 days.

(21) Appl. No.: 12/367,852

(22) Filed: Feb. 9, 2009

(65) Prior Publication Data

US 2010/0200726 A1 Aug. 12, 2010

(51) Int. Cl.
*F16M 1/00* (2006.01)

(52) U.S. Cl. ..... 248/646; 248/637; 248/676

(58) Field of Classification Search ..... 248/646, 248/647, 676, 637, 674, 678, 176.1; 382/152; 250/559.14
See application file for complete search history.

(56) References Cited

U.S. PATENT DOCUMENTS

| | | | | |
|---|---|---|---|---|
| 2,462,997 | A * | 3/1949 | Roush | 409/144 |
| 3,912,193 | A | 10/1975 | Calvaer | |
| 4,718,420 | A * | 1/1988 | Lemp | 606/166 |
| 4,901,157 | A | 2/1990 | Ohmori | |
| 4,904,877 | A | 2/1990 | Pietzsch | |
| 5,107,131 | A | 4/1992 | Okada et al. | |
| 5,435,517 | A * | 7/1995 | McGuire et al. | 248/637 |
| 5,661,561 | A | 8/1997 | Wurz et al. | |
| 6,085,978 | A | 7/2000 | Knowles et al. | |
| 6,137,577 | A | 10/2000 | Woodworth | |
| 6,476,870 | B2 | 11/2002 | Lemström et al. | |
| 6,534,763 | B2 | 3/2003 | Krohn et al. | |
| 6,548,812 | B1 | 4/2003 | Schumacher | |
| 6,586,739 | B2 | 7/2003 | Schumacher | |
| 6,606,403 | B2 * | 8/2003 | Freifeld | 382/152 |
| 6,696,685 | B2 | 2/2004 | Schumacher | |
| 6,783,068 | B2 | 8/2004 | Hecht | |
| 7,168,822 | B2 | 1/2007 | Abramovich et al. | |
| 7,253,889 | B2 | 8/2007 | Mysore et al. | |
| 7,336,197 | B2 | 2/2008 | Ding et al. | |
| 2003/0034447 | A1 | 2/2003 | Krohn et al. | |
| 2005/0151042 | A1 | 7/2005 | Watson | |
| 2007/0115464 | A1 | 5/2007 | Harding et al. | |
| 2007/0164202 | A1 | 7/2007 | Wurz et al. | |
| 2008/0135759 | A1 | 6/2008 | Yoshimura | |
| 2008/0198602 | A1 | 8/2008 | Brittain et al. | |
| 2009/0059038 | A1 * | 3/2009 | Seakins et al. | 348/240.99 |

FOREIGN PATENT DOCUMENTS

| | | | | |
|---|---|---|---|---|
| DE | 4339634 | | 5/1995 | |
| EP | 397617 | * | 11/1990 | 248/637 |
| EP | 2 011 755 | A1 | 1/2009 | |
| EP | 2 093 173 | A1 | 8/2009 | |
| JP | 2004063867 | | 2/2004 | |

(Continued)

OTHER PUBLICATIONS

International Search Report, dtd Apr. 27, 2010, 7 pages.

*Primary Examiner* — Ramon Ramirez
(74) *Attorney, Agent, or Firm* — Charles R. Matson

(57) ABSTRACT

Aspects of the present disclosure involve imaging equipment for viewing and/or monitoring substrates and components used to manufacture disposable absorbent articles as well as other types of articles and products. More particularly, the apparatuses and methods discussed herein relate to mounting, supporting, and aligning various types of vision systems, which may include a camera and a light source.

19 Claims, 11 Drawing Sheets

FOREIGN PATENT DOCUMENTS

| | | | |
|---|---|---|---|
| KR | 1020010056652 | A | 7/2001 |
| KR | 102005109215 | A | 11/2005 |
| KR | 100744472 | B1 | 7/2007 |
| KR | 1020070115274 | A | 12/2007 |
| KR | 100803043 | B1 | 2/2008 |
| WO | WO 9801746 | | 1/1998 |

* cited by examiner

APPARATUS AND METHOD FOR SUPPORTING AND ALIGNING IMAGING EQUIPMENT ON A WEB CONVERTING MANUFACTURING LINE

FIELD OF THE INVENTION

The present disclosure relates to methods and apparatuses for manufacturing disposable absorbent articles, and more particularly, methods and apparatuses for supporting and aligning imaging equipment for monitoring substrates used to manufacture disposable absorbent articles.

BACKGROUND OF THE INVENTION

Along an assembly line, diapers and various types of other absorbent articles may be assembled by adding components to and otherwise modifying an advancing, continuous web of material. For example, in some processes, advancing webs of material are combined with other advancing webs of material. In other examples, individual components created from advancing webs of material are combined with advancing webs of material, which in turn, are then combined with other advancing webs of material. Webs of material and component parts used to manufacture diapers may include: backsheets, topsheets, absorbent cores, front and/or back ears, fastener components, and various types of elastic webs and components such as leg elastics, barrier leg cuff elastics, and waist elastics. Once the desired component parts are assembled, the advancing web(s) and component parts are subjected to a final knife cut to separate the web(s) into discrete diapers or other absorbent articles. The discrete diapers or absorbent articles may also then be folded and packaged.

Various types of sensors and/or imaging equipment may be used to monitor advancing webs of material. The installation of certain types of imaging equipment can be relatively time consuming and cumbersome. For example, some imaging equipment includes a camera and a light source, and as such, installation requires alignment between the camera and the light source. However, the camera may be mounted on one support and the light source may be mounted a separate different support. Each support may provide various degrees of movement for the camera and light source, and as such, proper alignment of the camera with the light source can be a delicate and time consuming operation.

SUMMARY OF THE INVENTION

Aspects of the present disclosure involve imaging equipment for viewing and/or monitoring substrates and components used to manufacture disposable absorbent articles as well as other types of articles and products. More particularly, the apparatuses and methods discussed herein relate to mounting, supporting, and aligning various types of vision systems, which may include a camera and a light source.

In one form, an apparatus for supporting imaging equipment includes: a main support member including: a base member having a first end portion and a second end portion; a first member having a proximal end portion and a distal end portion, wherein the proximal end portion is connected with the first end portion of the base member, wherein the first member is adapted to support a light source; a second member having a proximal end portion and a distal end portion, wherein the proximal end portion is connected with the second end portion of the base member; wherein the distal end portion of the second member is adapted to support a camera; and an alignment member having a first end portion and a second end portion, wherein the first end portion is releasably connectable with the distal end portion of the first member and wherein the second end portion is releasably connectable with the base member, and wherein the alignment member includes at least one slot substantially parallel to the first member. In another form, an apparatus for supporting imaging equipment adapted to view an object includes: a main support member having: a base member having a first end portion, a second end portion, and a mid portion between the first and second end portions; a first member having a proximal end portion and a distal end portion, wherein the proximal end portion is connected with the base member; a second member having a proximal end portion and a distal end portion, wherein the proximal end portion is connected with the second end portion of the base member; a light source connected with the first member; and a camera connected with the second member.

In yet another form, a method for supporting and aligning imaging equipment on a web converting line includes the steps of: positioning a main support member to a fixture adjacent a substrate configured to advance in a machine direction, wherein the main support member comprises: a base member having a first end portion and a second end portion; a first member having a proximal end portion and a distal end portion, wherein the proximal end portion is connected with the first end portion of the base member; and a second member having a proximal end portion and a distal end portion, wherein the proximal end portion is connected with the second end portion of the base member; supporting a light source with the distal end portion of the first member and supporting a camera with the distal end portion of the second member, wherein the camera is positioned to view a substrate advancing in a machine direction between the first member and the second member and wherein the light source is positioned to extend in a cross direction adjacent the substrate; connecting an alignment member with the distal end portion of the first member and the base member, wherein the alignment member includes at least one slot; and directing light from the light source through the at least one slot toward the camera.

DETAILED DESCRIPTION OF THE INVENTION

Figure 1A:
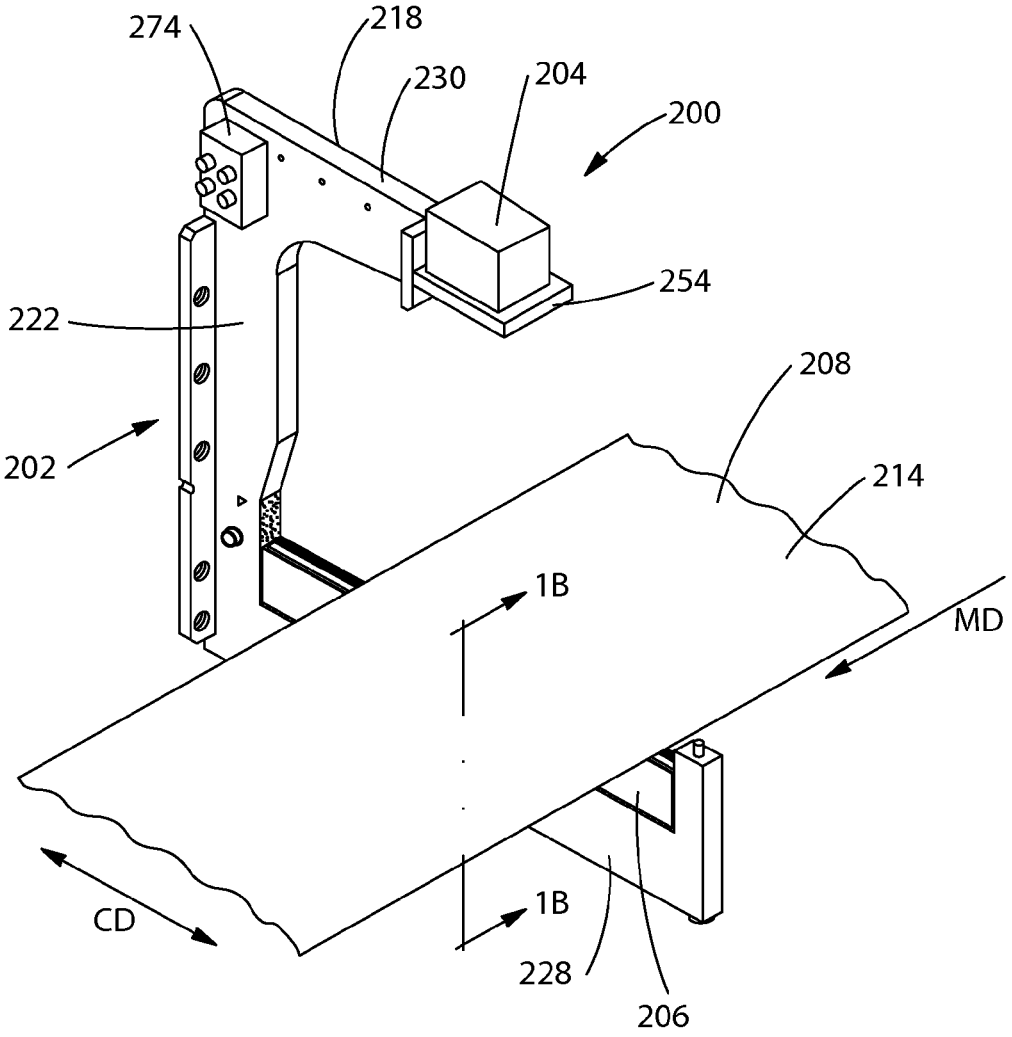
FIG. 1A is an isometric view of a support apparatus installed on a converter line.

The following term explanations may be useful in understanding the present disclosure:

"Absorbent article" is used herein to refer to consumer products whose primary function is to absorb and retain soils and wastes. "Diaper" is used herein to refer to an absorbent article generally worn by infants and incontinent persons about the lower torso. The term "disposable" is used herein to describe absorbent articles which generally are not intended to be laundered or otherwise restored or reused as an absorbent article (e.g., they are intended to be discarded after a single use and may also be configured to be recycled, composted or otherwise disposed of in an environmentally compatible manner).

The term "disposed" is used herein to mean that an element(s) is formed (joined and positioned) in a particular place or position as a macro-unitary structure with other elements or as a separate element joined to another element.

As used herein, the term "joined" encompasses configurations whereby an element is directly secured to another element by affixing the element directly to the other element, and configurations whereby an element is indirectly secured to another element by affixing the element to intermediate member(s) which in turn are affixed to the other element.

The term "substrate" is used herein to describe a material which is primarily two-dimensional (i.e. in an XY plane) and whose thickness (in a Z direction) is relatively small (i.e. 1/10 or less) in comparison to its length (in an X direction) and width (in a Y direction). Non-limiting examples of substrates include a layer or layers or fibrous materials, films and foils such as plastic films or metallic foils that may be used alone or laminated to one or more web, layer, film and/or foil. As such, a web is a substrate.

The term "nonwoven" refers herein to a material made from continuous (long) filaments (fibers) and/or discontinuous (short) filaments (fibers) by processes such as spunbonding, meltblowing, and the like. Nonwovens do not have a woven or knitted filament pattern.

The term "machine direction" (MD) is used herein to refer to the direction of material flow through a process. The term "cross direction" (CD) is used herein to refer to a direction that is generally perpendicular to the machine direction.

Aspects of the present disclosure involve apparatuses and methods for manufacturing absorbent articles, and more particularly, apparatuses and methods for supporting and aligning imaging equipment for viewing and/or monitoring substrates and components used to manufacture disposable absorbent articles. Although the present disclosure is provided in the context of manufacturing absorbent articles, it is to be appreciated that the apparatuses and methods disclosed herein may be applied to the manufacture of other types of articles and products involving the monitoring of various different types of substrates and/or components. Examples of other articles and products include packaging components and substrates and/or containers, such for example, as bottles. Further, it is to be appreciated that although the present disclosure often refers to monitoring or viewing substrates and/or webs, it is to be appreciated that the vision systems discussed herein can be used to monitor and/or view combinations of webs and individual components. Particular embodiments of methods and apparatuses disclosed herein provide for the support and alignment of various types of imaging systems. Vision systems associated with absorbent article converter lines may be used for various purposes. For example, vision systems may be used to monitor and detect defects in the substrates and products being assembled. In other examples, vision systems may used to detect the relative placement of various components of articles being assembled. As such, various types of feedback signals, such as images, results signals, and/or arithmetical variables, from the vision systems can be stored and/or sent to controllers on a converter line for display and/or use in operations, such as phasing control, registration control, and/or reject control. Some vision systems include a camera and light source, which require alignment for optimal operation. The apparatuses and methods discussed herein relate to mounting, supporting, and aligning various types of vision systems.

Figure 1B:
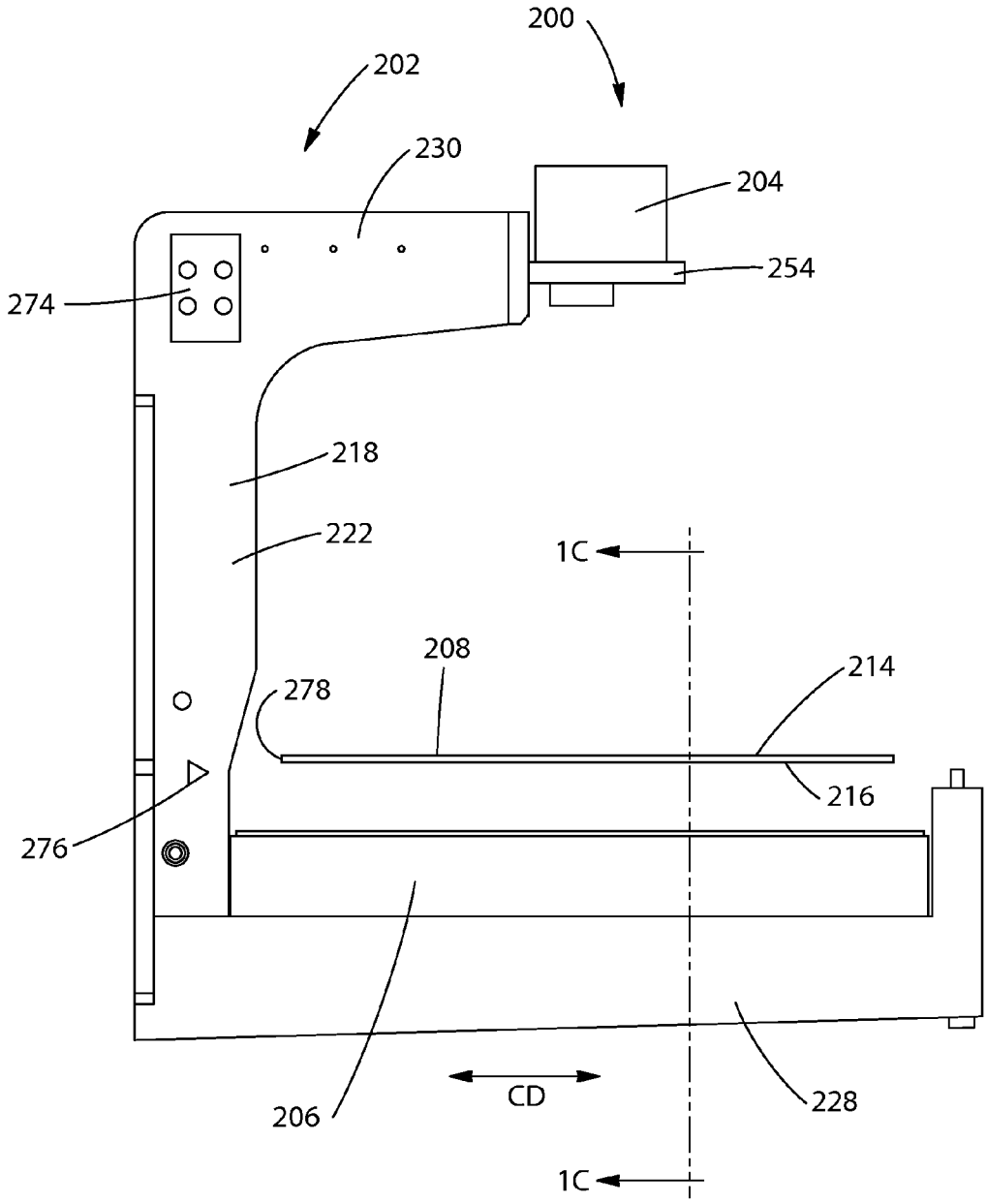
FIG. 1B shows a cross-sectional side view of the support apparatus of FIG. 1A looking in the MD direction taken along line 1B-1B.
Figure 1C:
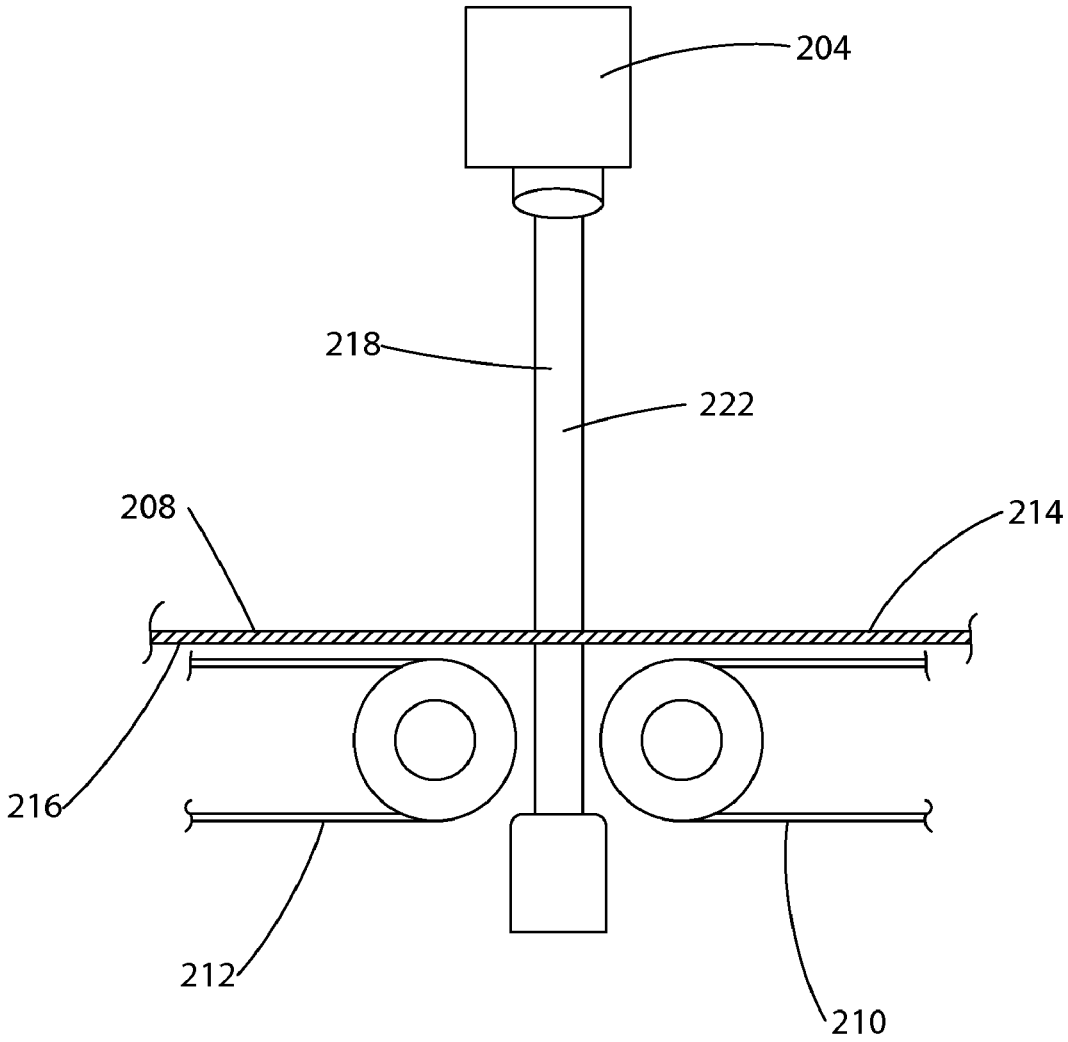
FIG. 1C shows a cross-sectional side view of the support apparatus of FIG. 1B looking in the CD direction taken along line 1C-1C.

It is to be appreciated that the methods and apparatuses according to the present disclosure may be adapted to work with different types of imaging systems. For example, some embodiments may be configured to work with an industrial linescan vision system. FIGS. 1A-1C show an embodiment of an imaging system 200 mounted on a support apparatus 202. As illustrated, the imaging system 200 may include a camera 204 and a light source 206. The support apparatus 202 is shown in FIGS. 1A-1C as being used in a manufacturing process disposed adjacent a substrate 208 advancing in a machine direction (MD) such that the camera 204 can monitor and/or view the advancing substrate 208. With reference to FIG. 1C, the substrate 208 is shown as advancing along a first conveyer 210 and a second conveyer 212, and the support apparatus 202 is positioned in a gap 214 in the machine direction (MD) between end portions of the conveyors 210, 212. As such, the camera 204 is positioned so as to view a top side or surface 214 of the advancing substrate 208 and the light source 206 is positioned so as to direct light onto a bottom side or surface 216 of the advancing substrate. The support apparatus 202 can be bolted or otherwise secured to a wall or some other fixture adjacent the advancing substrate. As discussed in more detail below, the support apparatus 202 can also be configured to provide air flow along the light source 206 to help maintain cleanliness and/or to help cool the light source. In addition, the support apparatus 202 can be configured to allow a user to move the camera 204 in a limited number of directions with respect to the light source 206 for relative ease of alignment of the camera with the light source.

Figure 2A:
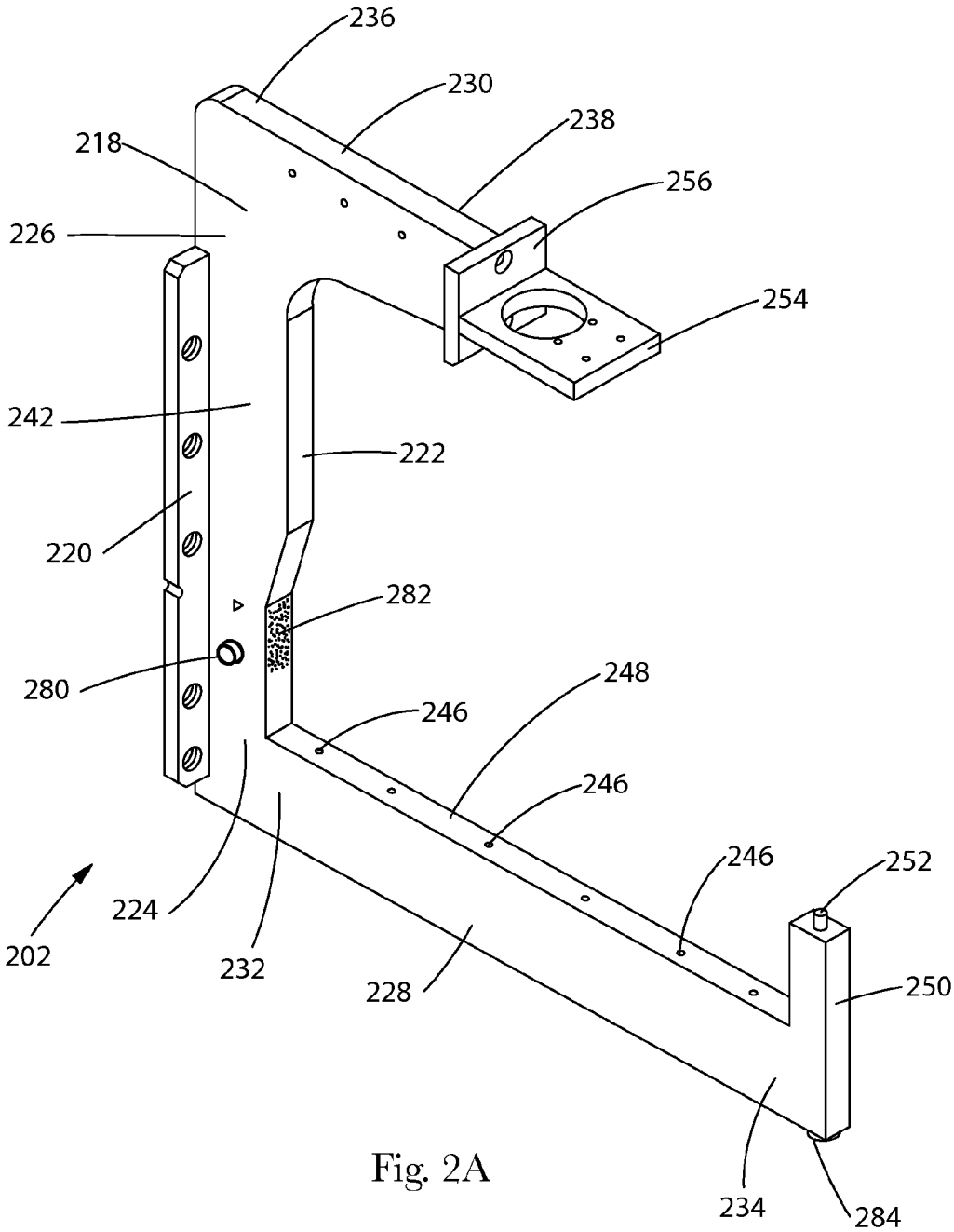
FIG. 2A is an isometric view of the support apparatus with the camera and light source removed.
Figure 2B:
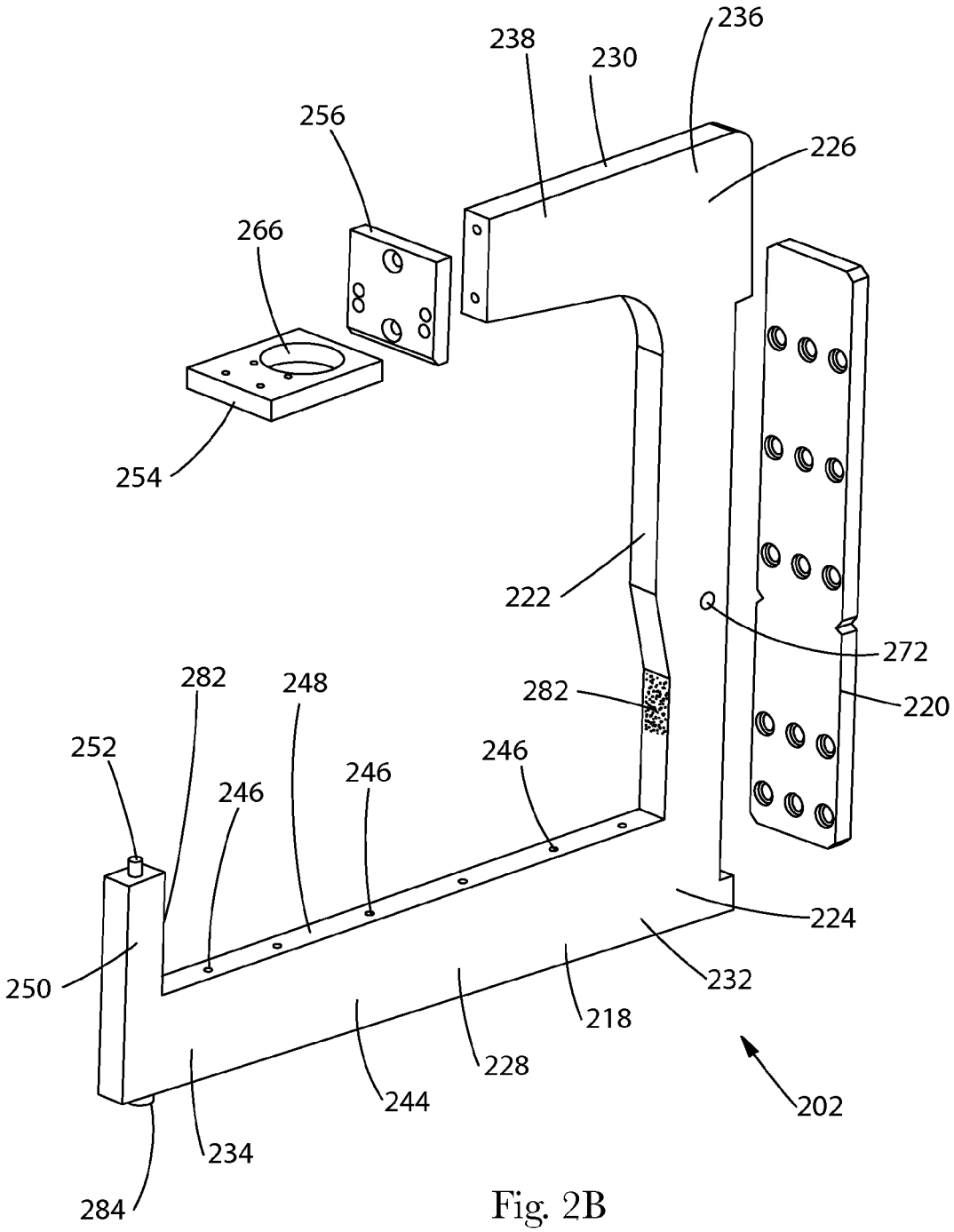
FIG. 2B is an exploded view of the support apparatus shown in FIG. 2A.

FIGS. 2A and 2B show an embodiment of the support apparatus 202 with the camera and light source removed therefrom. The support apparatus 202 includes a main support member 218 in the form of a C-shaped support structure having a securement plate 220 connected thereto that allows the support apparatus 202 to be connected to a wall or other type of fixed object. The main support member 218 includes an upright base member 222 having a first end portion 224 and a second portion 226 connected with a first support member 228 and a second support member 230, respectively. More particularly, the first support member 228 includes a proximal end portion 232 and distal end portion 234, wherein the proximal end portion 232 is connected with the first end portion 224 of the base member 222. In addition, the second support member 230 includes a proximal end portion 236 and distal end portion 238, wherein the distal end portion 238 is connected with the second end portion 226 of the base member 222. As discussed in more detail below, the first support member 228 is adapted to support the light source 206, and the second support member 230 is adapted to support the camera 204. The main support member 218 is also adapted to releasably connect with an alignment member 240 discussed in more detail below with reference to FIGS. 4A-4D.

It is to be appreciated that the main support member 218 may be constructed such that the base member 222, first support member 228, and second support member 230 are integrally formed as single piece of material. In other embodiments, the base member, first support member, and second support can be formed as separate pieces that are connected together in various ways to prevent movement relative to each other, such as with for example, fasteners, adhesives, or welding. In addition, the main support member 218 can also be made from different types of materials, such as metal, plastics, and carbon composites. For example, one embodiment of the main support member is constructed as a single integral piece made from aluminum. Further, the main support member 218 defines a thickness in the machine direction (MD) between a first side 242 and a second side 244. It is to be appreciated that the thickness of the main support member 218 may vary depending on the particular application. For example, in one embodiment, the thickness of the main support member in the MD direction is about 1 inch.

As previously mentioned, the first support member 228 is adapted to support the light source 206. Various types of light sources can be used with the support apparatus. As such, it is to be appreciated that the first support member 228 can configured in different ways depending on the type of light source 206 being utilized. For example, one embodiment may be configured to support LED line lights, such as, for example, the Advanced Illumination LL068 or Metaphase 17" line light. The support apparatus 202 can also be configured to work with fiber-optic illuminators, wherein fiber bundles may extend from the main support member 218 into halogen or other light sources. In some embodiments, the first support member 228 can be configured to accommodate air flow from cooling fans required by the particular light source being supported. As shown in FIGS. 2A and 2B, the first support member 228 may include a plurality of bolt holes 246 arranged on a top surface 248 of the first support member. The bolt holes 246 may be spaced to match with a corresponding pattern of holes on the light source. FIGS. 1A and 1B show different views of the light source 206 supported on the first support member 228. In particular, the light source 206 shown in FIGS. 1A and 2B is a linear light source having a plurality of LED's arranged along a length. In use, the light source directs light onto the bottom side 216 of the advancing substrate 208. Referring back to FIGS. 2A and 2B, the distal end portion 234 of the first support member 228 also includes an upright extension 250, and a pin 252 extending upwardly from the upright extension 250. As discussed in more detail below, the upright extension 250 is adapted to support a portion the alignment member 240 and the pin 252 helps prevent the alignment member from moving in the MD direction.

Figure 3A:
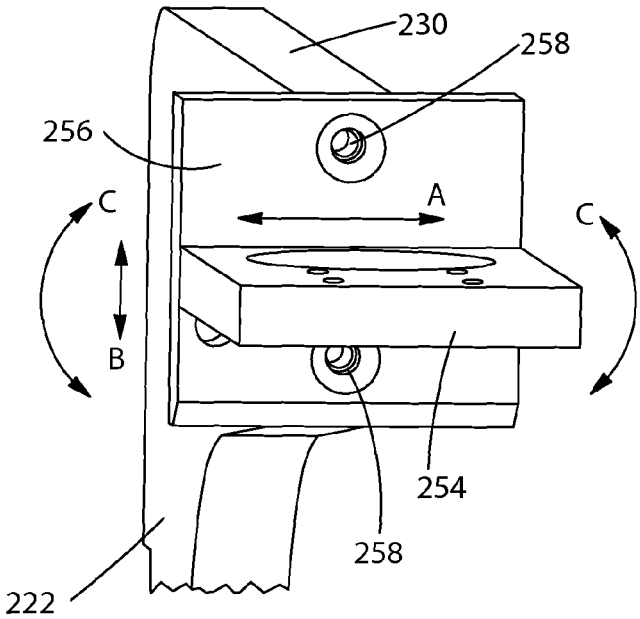
FIG. 3A is a detailed view of a distal end portion of a second support member shown in FIG. 2A.
Figure 3B:
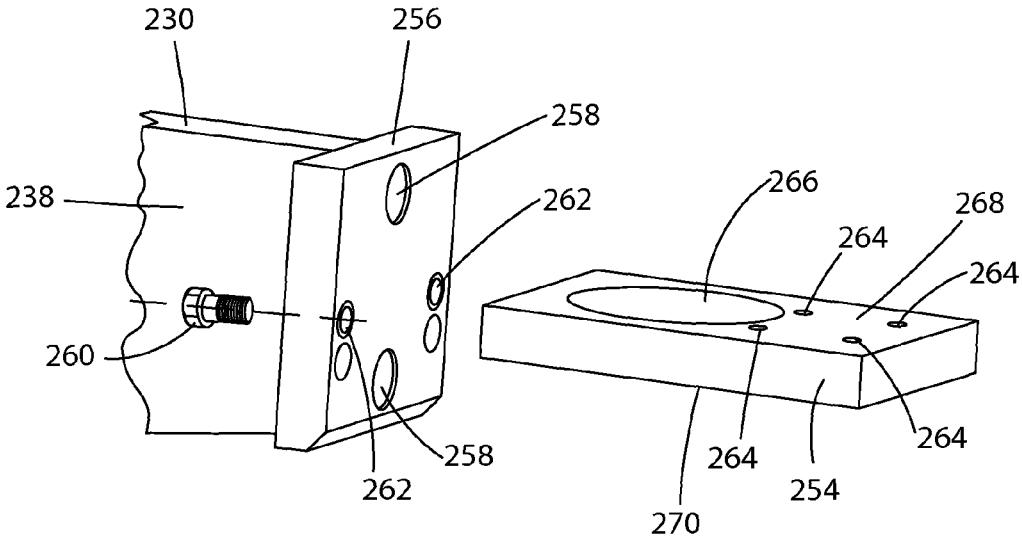
FIG. 3B is an exploded view of the distal end portion shown in FIG. 3A.

As previously mentioned, the second support member 230 is adapted to support the camera 204. As shown in FIGS. 2A and 2B, a support plate 254 and a base plate 256 are connected with the distal end portion 238 of the second support member 230. As discussed in more detail below, the camera 204 is supported by the support plate 254. Referring to FIGS. 3A and 3B, the base plate 256 is connected with the distal end portion 238 of the second support member 230 with two bolts 258. In turn, the support plate 254 is connected with the base plate 256 with two bolts 260. The two bolts 260 securing the support plate 254 to the base plate 256 extend through two corresponding through holes 262 in the base plate 256. The diameter of holes 262 in the base plate may be larger than the outer diameters of the bolts 260. As such, the support plate 254 can be moved relative to the base plate 256. More particularly, the position of the support plate can be adjusted: (1) back and forth along the MD direction (see directional arrow A); (2) up and down (see directional arrow B); and (3) partially rotated in the clockwise and counterclockwise directions (see directional arrow C) as shown in FIG. 3A. As discussed below, the support plate 254 can be moved during alignment of the camera with the light source.

Although one embodiment mounting and connection configuration between the support plate 254 and the main support member 218 is described and illustrated herein, it is to be appreciated that other connection and mounting configurations can also be used. For example, instead of using bolts 260, the support plate 254 may have threaded pins extending therefrom that are adapted to be received in the holes 262 in the base plate 256. In another configuration, the base plate 256 may have threaded pins extending therefrom that are adapted to be received within corresponding holes in the support plate 254. Yet other configurations can utilize straight or dovetailed slots and/or set screw arrangements to allow for connection and limited relative movement between the support plate 254 and the main support member 218. Still other configurations may utilize a mortis and tenon joint. It should also be appreciated that in some configurations, the support plate 254 can be connected directly to the second support member 230 without the use of the base plate 256. In other configurations, the support plate 254 and base plate 256 may be integrally formed as a single piece.

Various types of cameras can be used with the support apparatus 202. As such, it is to be appreciated that the second support member 230 and/or support plate 254 and base plate 256 can configured in different ways depending on the type of camera being supported. For example, one embodiment is configured to support a linescan camera, such as for example, the Basler Runner, a Dalsa Spyder Series, and DVT 540LS smart cameras. As shown in FIG. 3B, the support plate 254 includes a plurality of bolt holes 264 arranged on a top surface 268 of the support plate 254. The bolt holes 264 may be spaced to match with a corresponding pattern of holes on the camera. The support plate 254 may also include a lens aperture 266 adapted to accept a portion of the camera 204. FIGS. 1A and 1B show different views of the camera 204 mounted on the support plate 254. In use, the camera 204 is positioned to view the top side 214 of the advancing substrate 208. In some embodiments, the support plate 254 and lens aperture 266 can be configured with channels to direct air flow to help maintain the cleanliness of the camera lens. In some configurations, the lens aperture 266 and/or support plate 254 is adapted to connect with a protective cover for the camera lens. In other embodiments, the support plate 254 can be configured to suspend the camera from a bottom surface 270 of the support plate 254. In such a configuration, the bottom surface 270 of the support plate may include holes adapted to receive and engage corresponding bolts or pins extending from the camera. As such the support plate may not include a lens aperture. In some configurations, the support plate can be configured to connect with an optical filter to modify the light into the camera. For example, some optical filters can be configured to eliminate certain bandwidths of light, such as for example, IR or UV, or may include a bandpass filter to inhibit passage of all light except for a desired range.

As previously mentioned, the proximal end portions 232, 236 of the first support member 228 and the second support member 230 are connected with first and second end portions 224, 226 of the base support member 222, respectively, to define the main support member 218. The base support member 222 may include various structural features depending on the particular application of the support apparatus 202. For example, as shown in FIGS. 2A and 2B, the securement plate 220 that can be adapted to connect with a wall or other type of fixed object is connected with the base support member 222. It is to be appreciated that in some embodiments, the securement plate 220 can be formed integrally with the base support member 222. As discussed in more detail below and as shown in FIG. 2B, the base support member 222 also includes a hole 272 adapted to releasably connect with the alignment member 240. Also shown in FIGS. 1A and 1B, the support apparatus 202 may include an electrical junction box 274 connected with the base support member. The junction box 274 may provide access to external electrical connections and communications to the light source 206 and the camera 204 as well as providing access to various control functions, such as on/off switches. The base support member 222 may also include an alignment mark 276, which provides a user the ability to visually inspect the position of the support apparatus 202 relative to the substrate 208. For example, in some embodiments, the alignment mark 276 allows the user visually check if the support apparatus 202 is installed at a desired position relative to the substrate by verifying that the vertical alignment mark 276 is located at the same vertical height as an edge 278 the substrate 208.

The support apparatus 202 can also be configured to connect with an external air supply to direct air in desired locations to help keep dust and other debris from gathering on the light source and/or provide cooling to the light source. As shown in FIGS. 2A and 2B, the support apparatus 202 may include a first air inlet 280 on the base support member 222. Air entering the first air inlet 280 is directed through a passageway inside the base support member 222 and is discharged from a plurality of air discharge holes 282 in the base support member. The support apparatus 202 may also includes a second air inlet 284 on the distal end portion 234 of the first support member 228. Air entering the second air inlet 284 is directed through a passageway inside the first support member 228 and upright extension 250 and is discharged from a plurality of air discharge holes 282 in the upright extension. As such, air discharged from the air discharge holes 282 in the base support member 222 and the upright extension 250 is directed in a CD direction along the light source 206, which may help maintain the cleanliness of the light source and/or provide a cooling.

Figure 4A:
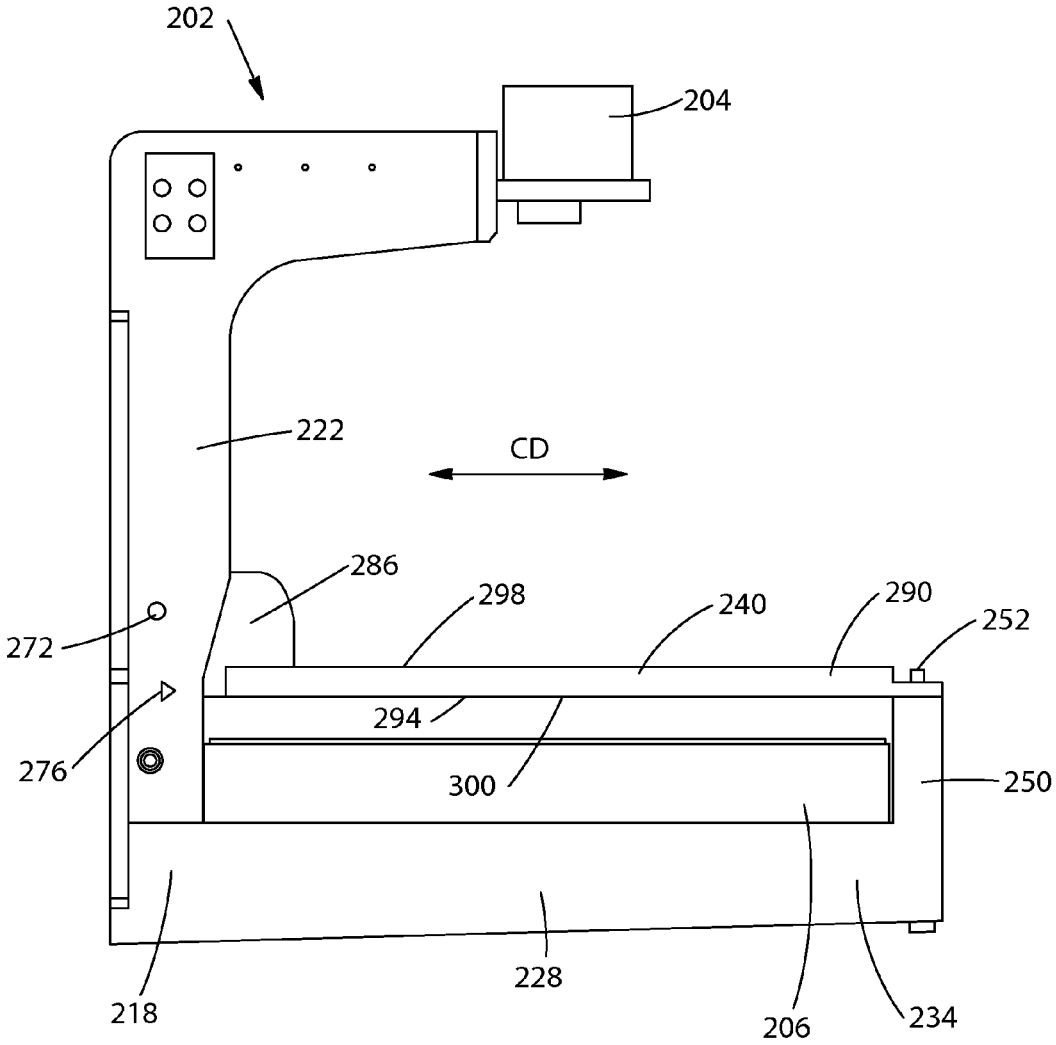
FIG. 4A is a side view of the support apparatus and alignment member.

As previously mentioned, the support apparatus 202 may also include an alignment member 240 to help align the camera 204 with the light source 206. The alignment member 240 may be configured to releasably connect with the main support member 218. FIGS. 4A-4D show an embodiment of the alignment member 240 adapted to connect with the main support member 218. When connected with the main support member 218, the alignment member 240 extends from the base support member 222 to the distal end portion 234 of the first support member 228. More particularly, a first end portion 286 of the alignment member 240 includes a pin 288 adapted to be received within the corresponding hole 272 in the base support member 222, and a second end portion 290 of the alignment member 240 includes a open slot 292 adapted to receive the corresponding pin 252 extending from the upright member 250 on the distal end portion 234 of the first support member 228. It is to be appreciated that the alignment member 240 and main support member 218 can be configured in other ways that allow the alignment member to releasably connect with the main support member, such as for example, with nuts and bolts. As shown in FIG. 4A, when the alignment member 240 is connected with the main support member 218, a bottom surface 294 of the alignment member 240 is vertically positioned relative to the camera 204 such that the bottom surface 294 is at the same position as the substrate 208 to be monitored relative to the camera. The vertical position of the bottom surface 294 of the alignment member 240 can be varied depending on the particular application. For example, in one embodiment the bottom surface of the alignment member is positioned 50 mm above a top surface of the light source.

Figure 4B:
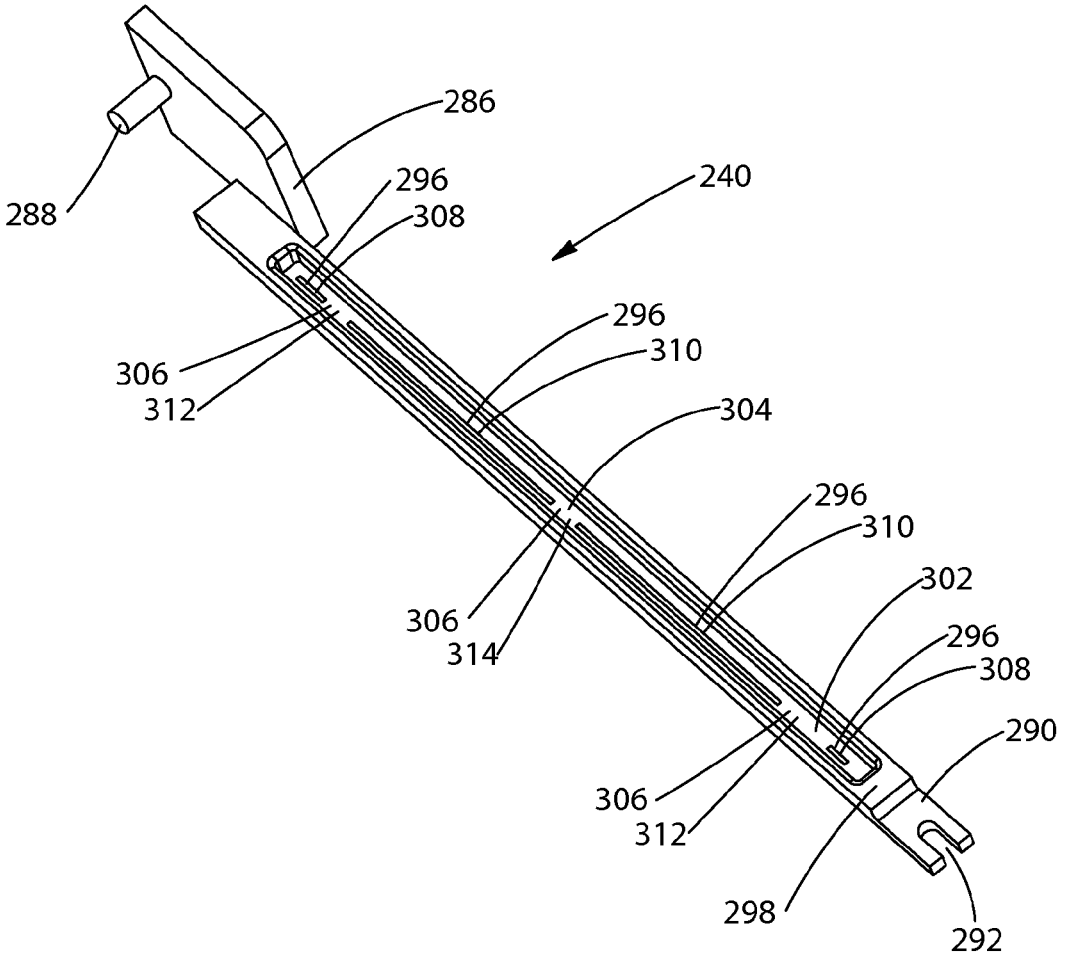
FIG. 4B is an isometric view of the alignment member.
Figure 4C:
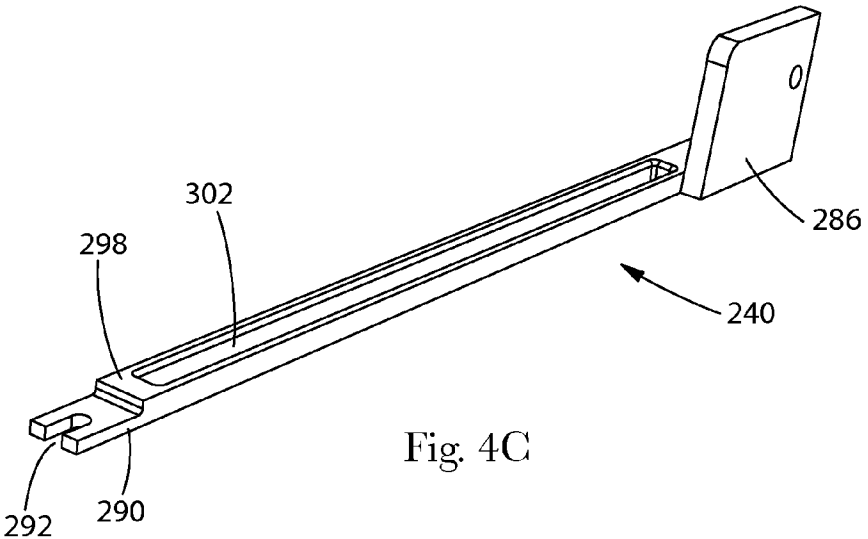
FIG. 4C is an isometric view of the alignment member.
Figure 4D:
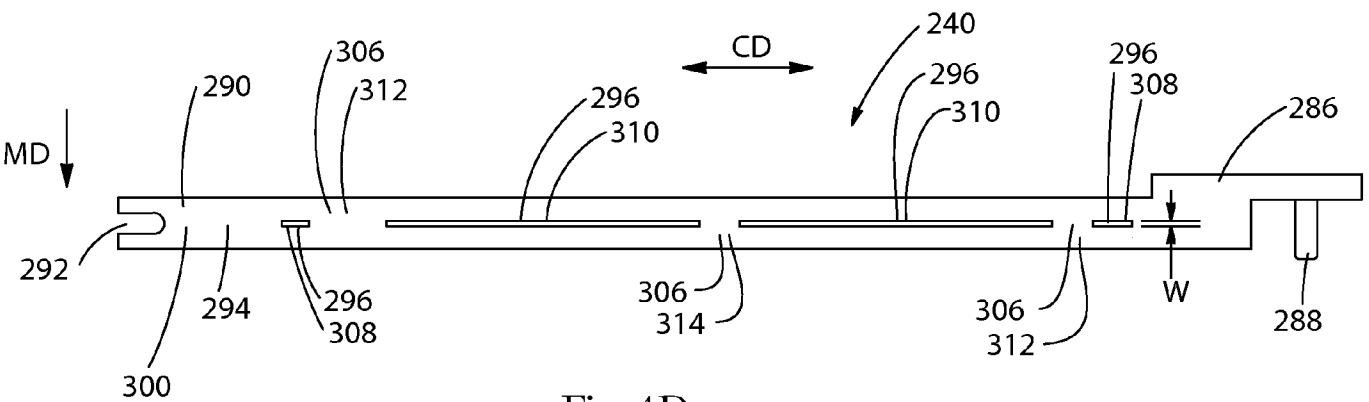
FIG. 4D is a bottom side view of the alignment member.

With reference to FIGS. 4B-4D, the alignment member 240 includes one or more slots 296 extending along the length of the alignment member, so that when the alignment member 240 is connected with main support member 218, the slots 296 extend along the CD direction. As discussed in more detail below, the slots 296 allow light from the light source to pass therethrough to provide guidance when aligning the camera with the light source. The alignment member 240 also defines a vertical thickness between a top side 298 and a bottom side 300. Depending on the particular configuration, the alignment member 240 may be constructed to define a vertical thickness that reduces the likelihood of bending of the alignment member when installed on the main support member 218.

In some embodiments, the vertical thickness of the alignment member 240 may be reduced in areas where the slots 296 are located, to help simplify the operation of focusing the camera lens. More particularly, during alignment of the camera 204 with the light source 206, the camera lens may be adjusted to until the optical edges of the image (e.g. the slots 296) are optimized. As such, when the slots 296 are located in and extend through relatively thin material (e.g. reduced vertical thickness of the alignment member), the optical edges presented by light passing through the slots 296 may be more defined or sharpened, and as thus, the edges of the slots present a relatively sharp optical edge to the camera. If the slots 296 extend through areas relatively thick material, light passing through the slots may also reflect off the vertical sides of the slots and cause distortion of the optical edges of the slots. Thus, as shown in FIGS. 4B-4D, the slots 296 may be located in a channel 302 extending between the first end portion 286 and the second end portion 290 of the alignment member 240. More particularly, the channel 302 extends into the alignment member 240 from the top side 298 toward the bottom side 300 to define a length of the alignment member having a reduced thickness between a top surface 304 and the bottom surface 294. It is to be appreciated that in other embodiments, the channel 302 may extend from the bottom side 300 toward the top side 302 of the alignment member 240. In addition, the sides of the channel 240 may be vertical or slanted with respect to the top surface 304 and/or bottom surface 294 of the alignment member 240.

In some embodiments, the alignment member 240 may include more than slot 296. For example, as shown in FIGS. 4B and 4D, the alignment member 240 may include four slots 296 separated by three bridges 306. In particular, the alignment member 240 includes two outer slots 308 and two inner slots 310. Two outer bridges 312 separate the outer slots 308 from the inner slots 310, and a middle bridge 314 separates the two inner slots 310. When the alignment member 240 is connected with the main support member 218, the slots 296 define widths, W, in the MD direction that may match a theoretical focal width of light from the light source 206 at the vertical position of the bottom surface 294 of the alignment member 240 relative to the top surface of the light source 206. As such, the width of the slots 296 in the MD direction can be configured such that the light passing through the slots 296 will provide a relatively constant illumination in the MD direction over slot width, and thus, the light is blocked in MD directions outside of the slot width. For example, in one embodiment, the MD width, W, of each slot is 2 mm. The slots 296 and bridges 306 can have various lengths in the CD direction depending on the particular application. For example, one embodiment may include outer slots 308 having CD lengths of 20 mm and inner slots 310 having CD lengths of 160 mm. In addition, the CD lengths of the bridges 306 may have CD lengths of 20 mm.

The slots 296 on the alignment member 240 may also be positioned to aid in the focus and alignment of the camera 204 relative to the light source 206. As discussed below, all the slots 296 may be used to align the camera 204 in the MD direction along with the camera pitch in the MD direction; the center bridge 314 may be used to verify alignment of the camera 204 in the CD direction; the outer slots 308 may be used to verify the full field of view of the camera 204; and all the bridges 306 may be used to measure and correct camera lens distortion. For example, in some embodiments, the two outer bridges 312 may have the same CD length as the middle bridge 314, which allows camera calibration in the CD direction to correct for lens "fisheye" effects or lens barrel distortion, which refers to an optical distortion of the camera lens wherein the apparent magnification of the lens decreases in proportion to the distance from the center of the optical axis. In addition, the two outer slots 308 may be positioned so as to match or exceed the expected camera field of view in the CD direction. As such, the lengths of the outer slots 308 in the CD direction can be used to help a user determine that the camera field of view is accurate. In some embodiments, the middle bridge 314 may be positioned such that a center point of the middle bridge is aligned with expected CD centerline of the substrate 208 to be viewed by the camera 204 during operation. As such, the CD position of the camera 204 can be more easily confirmed by checking that the middle bridge 314 appears in the center of the camera's image.

In some applications, the intensity of light from the light source may need to be reduced when aligning the camera 204 with the light source 206. Reduction in light intensity can be accomplished in various ways. In one example, the light intensity can be reduced by placing material, such as for example, paper, lexan, or other relatively thin translucent material in the channel 302 over the slots 296. In another example, the substrate 208 can be left in place while performing alignment. In other examples, it may be possible to reduce the power to the light source 206. In still other embodiments, it may be possible to adjust camera sensitivity through for example, gain, exposure time, and/or insertion of an optical filter.

When aligning the camera 204 with the light source 206, the alignment member 240 may be installed by inserting the pin 288 on the first end portion 286 into the corresponding hole 272 in the base member 222. The alignment member 240 may then pivoted downward such the second end portion 290 of the alignment member 240 is supported on the upright member 250 on the distal end portion 234 of the first support member 228. More particularly, the pin 252 on the upright member 250 may be inserted into the corresponding open slot 292 in the second end portion 290 of the alignment member 240. As such, light from the light source 206 passes through the slots 296 and upward toward the camera 204. The position of the camera can be adjusted by moving the support plate 254 on the second support member 230 as needed. In particular, the camera 204 may be moved (e.g. translation and rotation in the MD direction) to align the camera 204 with the light source 206. The camera 204 may be moved until light from the light source is observed evenly in all four slots 296 in the alignment member 240. Relatively precise machining of the mating surfaces between the support plate 254 and base plate 256 along with the precise alignment of the light source 206 to the first member 228 helps prevent rotational misalignment between the camera 204 and light source 206 in the CD direction. After tightening the bolts 260 between the support plate 254 and base plate 256 to secure the camera 204 into a fixed position, the camera 204 may be focused by optimizing the observed edges of the slots 296 adjacent the bridges 306. Finally, a calibration is calculated by comparing the CD size of each bridge 306 and/or slot 296 to the known, measured size of the same bridge 306 and/or slot 296. A lens fisheye effect is calculated by comparing the calculated calibration factor at the edge of the field of view of the camera with the calculated calibration factor in the center of the field of view.

As discussed above, embodiments of the support apparatus 202 may be configured for backlighting a desired object or substrate 208, wherein the substrate 208 is translucent and allows light to be directed onto the bottom surface 216 of the substrate and travel through the substrate to the camera 204. As such, varying translucencies of the substrate 208 may create contrasts in the image. It is to be appreciated that some embodiments of the support apparatus 202 can be also configured to apply light to the same surface of the substrate 208 or object being viewed, for example, the top surface 214. Such a configuration may be used to view imaging artwork or other designs on one side of the substrate; viewing a substrate that is opaque (such as steel or cardboard); and/or imaging a non-web object. For example, such a configuration may be used to with a vision system that monitors packaging materials to verify that the artwork and barcodes and are printed correctly thereon.

Figure 5:
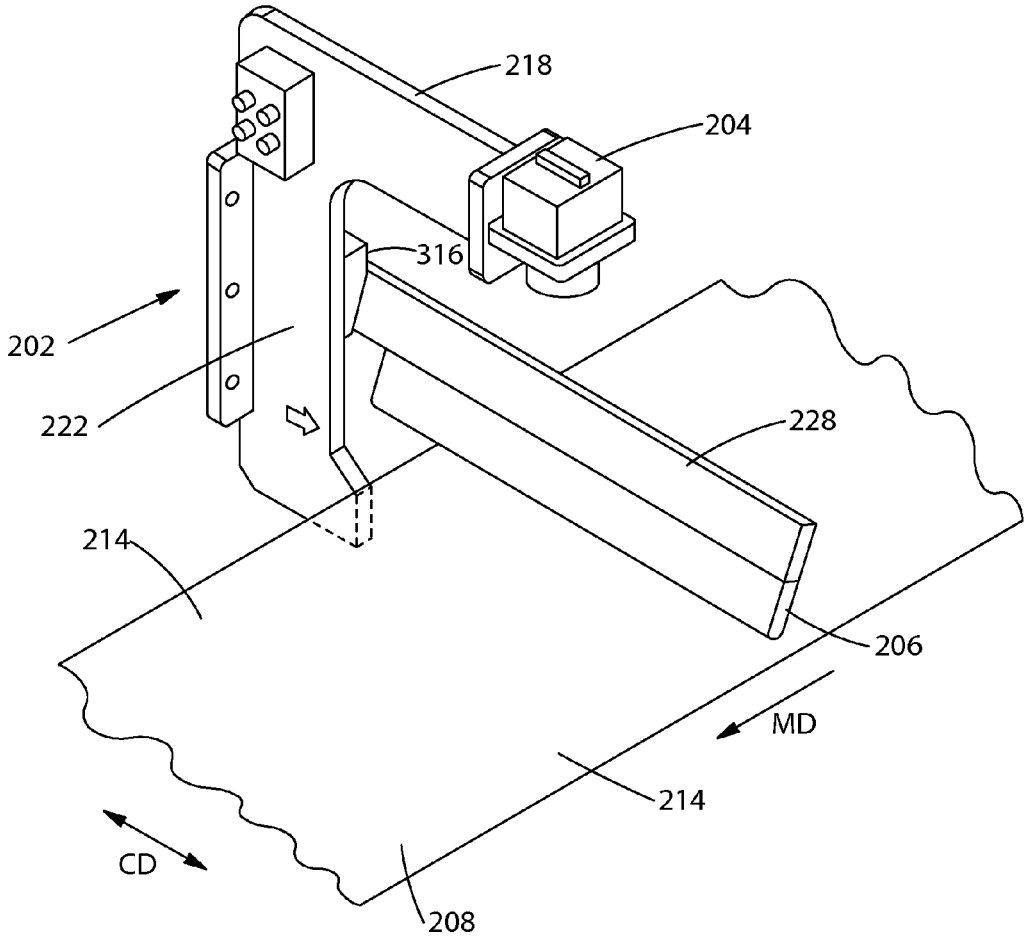
FIG. 5 is an isometric view of a second embodiment of the support apparatus.

FIG. 5 shows an embodiment of the support apparatus 202 configured to provide light to the same surface of the substrate 208 (i.e. the top surface 214) as being viewed by the camera 204. As shown, a wedge-shaped adapter 316 is connected with the base support member 222. In turn, the first support member 228 is connected with the adapter 316, and the light source 206 is connected with the first support member 228. As such, the light source 206 is positioned to direct light downward onto the top surface 214 of the substrate 208, light from the light source 206 reflects or refracts from the substrate 206 toward the camera 204. During alignment, the alignment member 240 can be positioned along the top surface 214 of the substrate and the position of the camera 204 position can be adjusted as discussed above. In some embodiments, the top side 298 of the alignment member 240 may be colored matte black to help the alignment member absorb light, while a white substrate positioned underneath the alignment member reflects or refracts light back to the camera 204. In other embodiments, the top side 298 of the alignment member 240 may be reflective, which helps to create dark regions in the slots 296.

Figure 6:
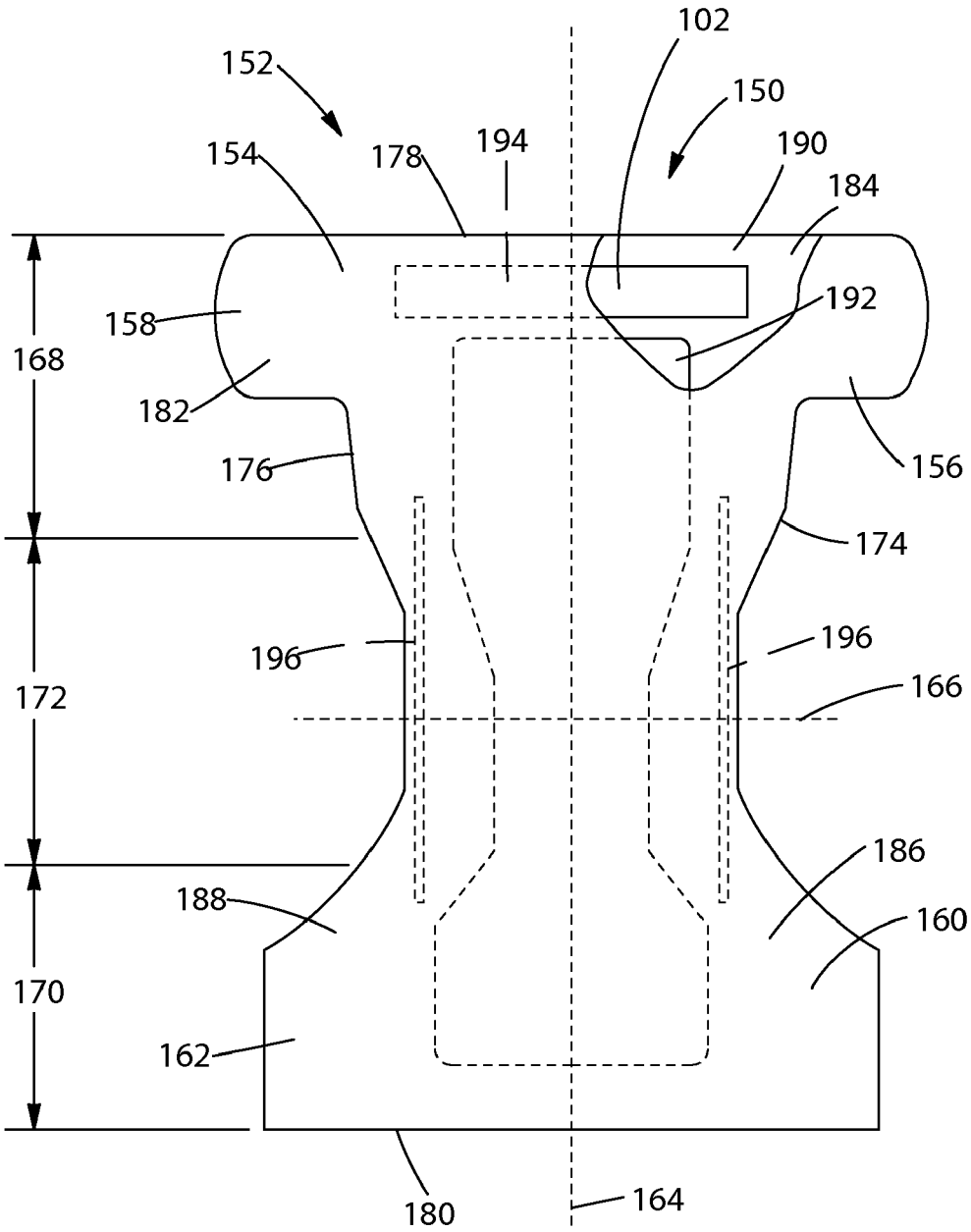
FIG. 6 is a top plan view of a disposable absorbent article that may include one or more substrates and/or components monitored and/or viewed by a vision system supported and/or aligned in accordance with the present disclosure.

As previously mentioned, the apparatuses and methods herein may be used to support and align vision systems used to monitor various types of substrates and components during the manufacture of various different products. For the purposes of a specific illustration, FIG. 6 shows one example of a disposable absorbent article 150 in the form of a diaper 152 that may be constructed from substrates and components monitored by vision systems during manufacture supported and aligned according to the apparatuses and methods disclosed herein. In particular, FIG. 6 is a plan view of one embodiment of a diaper 152 including a chassis 154 shown in a flat, unfolded condition, with the portion of the diaper 152 that faces a wearer oriented towards the viewer. A portion of the chassis structure is cut-away in FIG. 6 to more clearly show the construction of and various features that may be included in embodiments of the diaper.

As shown in FIG. 6, the diaper 152 includes a chassis 154 having a first ear 156, a second ear 158, a third ear 160, and a fourth ear 162. To provide a frame of reference for the present discussion, the chassis is shown with a longitudinal axis 164 and a lateral axis 166. The chassis 154 is shown as having a first waist region 168, a second waist region 170, and a crotch region 172 disposed intermediate the first and second waist regions. The periphery of the diaper is defined by a pair of longitudinally extending side edges 174, 176; a first outer edge 178 extending laterally adjacent the first waist region 168; and a second outer edge 180 extending laterally adjacent the second waist region 170. As shown in FIG. 6, the chassis 154 includes an inner, body-facing surface 182, and an outer, garment-facing surface 184. A portion of the chassis structure is cut-away in FIG. 6 to more clearly show the construction of and various features that may be included in the diaper. As shown in FIG. 6, the chassis 154 of the diaper 152 may include an outer covering layer 186 including a topsheet 188 and a backsheet 190. An absorbent core 192 may be disposed between a portion of the topsheet 188 and the backsheet 190. As discussed in more detail below, any one or more of the regions may be stretchable and may include an elastomeric material or laminate as described herein. As such, the diaper 152 may be configured to adapt to a specific wearer's anatomy upon application and to maintain coordination with the wearer's anatomy during wear.

As previously mentioned, the chassis 154 of the diaper 152 may include the backsheet 190, shown for example, in FIG. 6. In some embodiments, the backsheet is configured to prevent exudates absorbed and contained within the chassis from soiling articles that may contact the diaper, such as bedsheets and undergarments. Some embodiments of the backsheet may be fluid permeable, while other embodiments may be impervious to liquids (e.g., urine) and comprises a thin plastic film. In some embodiments, the plastic film includes a thermoplastic film having a thickness of about 0.012 mm (0.5 mil) to about 0.051 mm (2.0 mils). Some backsheet films may include those manufactured by Tredegar Industries Inc. of Terre Haute, Ind. and sold under the trade names X15306, X10962, and X10964. Other backsheet materials may include breathable materials that permit vapors to escape from the diaper while still preventing exudates from passing through the backsheet. Exemplary breathable materials may include materials such as woven webs, nonwoven webs, composite materials such as film-coated nonwoven webs, and microporous films. Suitable breathable composite materials are described in greater detail in PCT Application No. WO 95/16746, published on Jun. 22, 1995 in the name of E. I. DuPont and U.S. Pat. No. 5,865,823, issued on Feb. 2, 1999 to Curro, both of which are hereby incorporated by reference herein. Other breathable backsheets including nonwoven webs and apertured formed films are described in U.S. Pat. No. 5,571,096 issued to Dobrin et al. on Nov. 5, 1996; and U.S. Pat. No. 6,573,423 issued to Herrlein et al. on Jun. 3, 2003, which are all hereby incorporated by reference herein.

The backsheet 190, or any portion thereof, may be stretchable in one or more directions. In one embodiment, the backsheet may comprise a structural elastic-like film ("SELF") web. Embodiments of SELF webs are more completely described in U.S. Pat. No. 5,518,801, entitled "Web Materials Exhibiting Elastic-Like Behavior," which issued to Chappell et al. on May 21, 1996, U.S. Pat. No. 5,723,087, entitled "Web Materials Exhibiting Elastic-Like Behavior," which issued to Chappell et al. on Mar. 3, 1998; U.S. Pat. No. 5,691,035, entitled "Web Materials Exhibiting Elastic-Like Behavior," which issued to Chappell et al. on Nov. 25, 1997; U.S. Pat. No. 5,891,544, entitled "Web Materials Exhibiting Elastic-Like Behavior," which issued to Chappell et al. on Apr. 6, 1999; U.S. Pat. No. 5,916,663, entitled "Web Materials Exhibiting Elastic-Like Behavior," which issued to Chappell et al. on Jun. 29, 1999; and U.S. Pat. No. 6,027,483, entitled "Web Materials Exhibiting Elastic-Like Behavior," which issued to Chappell et al. on Feb. 22, 2000, which are all hereby incorporated by reference herein. In some embodiments, the backsheet may comprise elastomeric films, foams, strands, nonwovens, or combinations of these or other suitable materials with nonwovens or synthetic films. Additional embodiments include backsheets that comprise a stretch nonwoven material; an elastomeric film in combination with an extensible nonwoven; an elastomeric nonwoven in combination with an extensible film; and/or combinations thereof. Details on such backsheet embodiments are more completely described in U.S. application Ser. Nos. 11/599,829; 11/599,851; and 11/599,862, which are all hereby incorporated by reference herein.

The backsheet 190 may be joined with the topsheet 188, the absorbent core 192, and/or other elements of the diaper 152 in various ways. For example, the backsheet may be connected with a uniform continuous layer of adhesive, a patterned layer of adhesive, or an array of separate lines, spirals, or spots of adhesive. One embodiment utilizes an open pattern network of filaments of adhesive as disclosed in U.S. Pat. No. 4,573,986, entitled "Disposable Waste-Containment Garment," which issued to Minetola et al. on Mar. 4, 1986, which is hereby incorporated by reference herein. Other embodiments utilize several lines of adhesive filaments which are swirled into a spiral pattern, as is illustrated by the apparatus and methods shown in U.S. Pat. No. 3,911,173, issued to Sprague, Jr. on Oct. 7, 1975; U.S. Pat. No. 4,785,996, issued to Ziecker, et al. on Nov. 22, 1988; and U.S. Pat. No. 4,842,666 issued to Werenicz on Jun. 27, 1989, which are all hereby incorporated by reference herein. Adhesives may include those manufactured by H. B. Fuller Company of St. Paul, Minn. and marketed as HL-1620 and HL-1358-XZP. In some embodiments, the backsheet is connected with heat bonds, pressure bonds, ultrasonic bonds, dynamic mechanical bonds, or any other suitable attachment means or a combination thereof.

The topsheet 188 may be constructed to be compliant, soft feeling, and non-irritating to the wearer's skin. Further, all or at least a portion of the topsheet 140 may be liquid pervious, permitting liquid to readily penetrate therethrough. As such, the topsheet may be manufactured from a wide range of materials, such as porous foams; reticulated foams; apertured nonwovens or plastic films; or woven or nonwoven webs of natural fibers (e.g., wood or cotton fibers), synthetic fibers (e.g., polyester or polypropylene fibers), or a combination of natural and synthetic fibers. If the absorbent assemblies include fibers, the fibers may be spunbonded, carded, wet-laid, meltblown, hydroentangled, or otherwise processed as is known in the art. One example of a topsheet including a web of staple length polypropylene fibers is manufactured by Veratec, Inc., a Division of International Paper Company, of Walpole, Mass. under the designation P-8. Examples of formed film topsheets are described in U.S. Pat. No. 3,929,135, entitled "Absorptive Structures Having Tapered Capillaries," which issued to Thompson on Dec. 30, 1975; U.S. Pat. No. 4,324,246, entitled "Disposable Absorbent Article Having A Stain Resistant Topsheet," which issued to Mullane, et al. on Apr. 13, 1982; U.S. Pat. No. 4,342,314, entitled "Resilient Plastic Web Exhibiting Fiber-Like Properties," which issued to Radel, et al. on Aug. 3, 1982; U.S. Pat. No. 4,463,045, entitled "Macroscopically Expanded Three-Dimensional Plastic Web Exhibiting Non-Glossy Visible Surface and Cloth-Like Tactile Impression," which issued to Ahr, et al. on Jul. 31, 1984; and U.S. Pat. No. 5,006,394, entitled "Multilayer Polymeric Film," which issued to Baird on Apr. 9, 1991, all of which are hereby incorporated by reference herein. Other topsheets may be made in accordance with U.S. Pat. Nos. 4,609,518 and 4,629,643, which issued to Curro et al. on Sep. 2, 1986, and Dec. 16, 1986, respectively, both of which are hereby incorporated by reference herein. Such formed films are available from The Procter & Gamble Company of Cincinnati, Ohio as "DRI-WEAVE" and from Tredegar Corporation of Terre Haute, Ind. as "CLIFF-T."

In some embodiments, the topsheet 188 is made of a hydrophobic material or is treated to be hydrophobic in order to isolate the wearer's skin from liquids contained in the absorbent core. If the topsheet is made of a hydrophobic material, at least the upper surface of the topsheet may be treated to be hydrophilic so that liquids will transfer through the topsheet more rapidly. This diminishes the likelihood that body exudates will flow off the topsheet rather than being drawn through the topsheet and being absorbed by the absorbent core. The topsheet can be rendered hydrophilic by treating it with a surfactant or by incorporating a surfactant into the topsheet. Suitable methods for treating the topsheet with a surfactant include spraying the topsheet material with the surfactant and immersing the material into the surfactant. A more detailed discussion of such a treatment and hydrophilicity is contained in U.S. Pat. No. 4,988,344, entitled "Absorbent Articles with Multiple Layer Absorbent Layers," which issued to Reising, et al. on Jan. 29, 1991, and U.S. Pat. No. 4,988,345, entitled "Absorbent Articles with Rapid Acquiring Absorbent Cores," which issued to Reising on Jan. 29, 1991, all of which are hereby incorporated by reference herein. A more detailed discussion of some methods for incorporating surfactant in the topsheet can be found in U.S. Statutory Invention Registration No. H 1670, which was published on Jul. 1, 1997, in the names of Aziz et al., all of which are hereby incorporated by reference herein.

In some embodiments, the topsheet 188 may include an apertured web or film that is hydrophobic. This may be accomplished eliminating the hydrophilizing treatment step from the production process and/or applying a hydrophobic treatment to the topsheet, such as a polytetrafluoroethylene compound like SCOTCHGUARD or a hydrophobic lotion composition, as described below. In such embodiments, the apertures may be large enough to allow the penetration of aqueous fluids like urine without significant resistance. A more detailed discussion of various apertured topsheets can be found in U.S. Pat. No. 5,342,338, entitled "Disposable Absorbent Article for Low-Viscosity Fecal Material," which issued to Roe on Aug. 30, 1994; U.S. Pat. No. 5,941,864, entitled "Disposable Absorbent Article having Improved Fecal Storage," which issued to Roe on Aug. 24, 1999; U.S. Pat. No. 6,010,491, entitled "Viscous Fluid Bodily Waste Management Article," which issued to Roe et al. on Jan. 4, 2000; and U.S. Pat. No. 6,414,215, entitled "Disposable Absorbent Article having Capacity to Store Low-Viscosity Fecal Material," which issued to Roe on Jul. 2, 20002, all of which are hereby incorporated by referenced herein. Embodiments of the absorbent article may also include pockets for receiving and containing waste, spacers which provide voids for waste, barriers for limiting the movement of waste in the article, compartments or voids which accept and contain waste materials deposited in the diaper, and the like, or any combinations thereof.

The absorbent core 192 may include absorbent material that is generally compressible, conformable, non-irritating to the wearer's skin, and capable of absorbing and retaining liquids such as urine and other body exudates. The absorbent core 192 can also be manufactured in a wide variety of sizes and shapes (e.g., rectangular, hourglass, T-shaped, asymmetric, etc.). The absorbent core may also include a wide variety of liquid-absorbent materials commonly used in disposable diapers and other absorbent articles. In one example, the absorbent core includes comminuted wood pulp, which is generally referred to as airfelt. Examples of other absorbent materials include creped cellulose wadding; meltblown polymers, including coform; chemically stiffened, modified or cross-linked cellulosic fibers; tissue, including tissue wraps and tissue laminates; absorbent foams; absorbent sponges; superabsorbent polymers; absorbent gelling materials; or any other known absorbent material or combinations of materials.

Exemplary absorbent structures are described in U.S. Pat. No. 4,610,678, entitled "High-Density Absorbent Structures," which issued to Weisman et al. on Sep. 9, 1986; U.S. Pat. No. 4,673,402, entitled "Absorbent Articles With Dual-Layered Cores," which issued to Weisman et al. on Jun. 16, 1987; U.S. Pat. No. 4,834,735, entitled "High Density Absorbent Members Having Lower Density and Lower Basis Weight Acquisition Zones," which issued to Alemany et al. on May 30, 1989; U.S. Pat. No. 4,888,231, entitled "Absorbent Core Having A Dusting Layer," which issued to Angstadt on Dec. 19, 1989; U.S. Pat. No. 5,137,537, entitled "Absorbent Structure Containing Individualized, Polycarboxylic Acid Crosslinked Wood Pulp Cellulose Fibers," which issued to Herron et al. on Aug. 11, 1992; U.S. Pat. No. 5,147,345, entitled "High Efficiency Absorbent Articles For Incontinence Management," which issued to Young et al. on Sep. 15, 1992; U.S. Pat. No. 5,342,338, entitled "Disposable Absorbent Article For Low-Viscosity Fecal Material," issued to Roe on Aug. 30, 1994; U.S. Pat. No. 5,260,345, entitled "Absorbent Foam Materials For Aqueous Body Fluids and Absorbent Articles Containing Such Materials," which issued to DesMarais et al. on Nov. 9, 1993; U.S. Pat. No. 5,387,207, entitled "Thin-Until-Wet Absorbent Foam Materials For Aqueous Body Fluids And Process For Making Same," which issued to Dyer et al. on Feb. 7, 1995; and U.S. Pat. No. 5,650,222, entitled "Absorbent Foam Materials For Aqueous Fluids Made From high Internal Phase Emulsions Having Very High Water-To-Oil Ratios," which issued to DesMarais et al. on Jul. 22, 1997, all of which are hereby incorporated by reference herein.

The absorbent core 192 may also have a multiple layered construction. A more detailed discussion of various types of multi-layered absorbent cores can be found in U.S. Pat. No. 5,669,894, entitled "Absorbent Members for Body Fluids having Good Wet Integrity and Relatively High Concentrations of Hydrogel-forming Absorbent Polymer," issued to Goldman et al. on Sep. 23, 1997; U.S. Pat. No. 6,441,266, entitled "Absorbent Members for Body Fluids using Hydrogel-forming Absorbent Polymer," issued to Dyer et al. on Aug. 26, 2002; U.S. Pat. No. 5,562,646, entitled "Absorbent Members for Body Fluids having Good Wet Integrity and Relatively High Concentrations of Hydrogel-forming Absorbent Polymer having High Porosity," issued to Goldman et al. on Oct. 10, 1996; European Pat. No. EP0565606B1, published on Mar. 8, 1995; U.S. Pat. Publication No. 2004/0162536A1 published Aug. 19, 2004; U.S. Pat. Publication No. 2004/0167486A1 published on Aug. 26, 2004; and PCT Publication No. WO 2006/015141 published on Feb. 9, 2006, which are all hereby incorporated by reference herein. In some embodiments, the absorbent article includes an absorbent core that is stretchable. In such a configuration, the absorbent core may be adapted to extend along with other materials of the chassis in longitudinal and/or lateral directions. The absorbent core can also be connected with the other components of the chassis various ways. For example, the diaper may include a "floating core" configuration or a "bucket" configuration wherein the diaper includes an anchoring system that can be configured to collect forces tending to move the article on the wearer.

The absorbent article may also include an elastic waist feature 102 shown in FIG. 6 in the form of a waist band 194 and may provide improved fit and waste containment. The elastic waist feature 102 may be configured to elastically expand and contract to dynamically fit the wearer's waist. The elastic waist feature 102 can be incorporated into the diaper in accordance with the methods discussed herein and may extend at least longitudinally outwardly from the absorbent core 192 and generally form at least a portion of the first and/or second outer edges 178, 180 of the diaper 152. In addition, the elastic waist feature may extend laterally to include the ears. While the elastic waist feature 102 or any constituent elements thereof may comprise one or more separate elements affixed to the diaper, the elastic waist feature may be constructed as an extension of other elements of the diaper, such as the backsheet 190, the topsheet 188, or both the backsheet and the topsheet. In addition, the elastic waist feature 102 may be disposed on the outer, garment-facing surface 184 of the chassis 140; the inner, body-facing surface 182; or between the inner and outer facing surfaces. The elastic waist feature 102 may be constructed in a number of different configurations including those described in U.S. patent application Ser. No. 11/303,686, filed on Dec. 16, 2005; U.S. patent application Ser. No. 11/303,306, filed on Dec. 16, 2005; and U.S. patent application Ser. No. 11/599,862, filed on Nov. 15, 2006; all of which are hereby incorporated by reference herein.

Although the first and second ears 156, 158 as well as the third and fourth ears 160, 162 shown in FIG. 6 are illustrated as being integrally formed with the chassis 140, it is to be appreciated that other embodiments may include ears that are discrete elements connected with the chassis. In some embodiments, the ears are configured to be stretchable, and in some embodiments, it may be preferable to have elastically stretchable ears. As discussed in more detail below, the ears may also include one or more fastener elements adapted to releasably connect with each other and/or other fastener elements on the chassis. A more detailed discussion of stretchable ears can be found in U.S. Pat. No. 4,857,067, entitled "Disposable Diaper Having Shirred Ears" issued to Wood, et al. on Aug. 15, 1989; U.S. Pat. No. 5,151,092 issued to Buell et al. on Sep. 29, 1992; U.S. Pat. No. 5,674,216 issued to Buell et al. on Oct. 7, 1997; U.S. Pat. No. 6,677,258 issued to Carroll et al. on Jan. 13, 2004; U.S. Pat. No. 4,381,781 issued to Sciaraffa, et al. on May 3, 1983; U.S. Pat. No. 5,580,411 entitled "Zero Scrap Method For Manufacturing Side Panels For Absorbent Articles" issued to Nease, et al. on Dec. 3, 1996; and U.S. Pat. No. 6,004,306 entitled "Absorbent Article With Multi-Directional Extensible Side Panels" issued to Robles et al. on Dec. 21, 1999, which are all hereby incorporated by reference herein. The ears may also include various geometries and arrangements of stretch zones or elements, such as discussed in U.S. Pat. Publication No. US2005/0215972A1 published on Sep. 29, 2005, and U.S. Pat. Publication No. US2005/0215973A1 published on Sep. 29, 2005, which are all hereby incorporated by reference herein.

As shown in FIG. 6, the diaper 152 may include leg cuffs 196 that may provide improved containment of liquids and other body exudates. In particular, elastic gasketing leg cuffs can provide a sealing effect around the wearer's thighs to prevent leakage. It is to be appreciated that when the diaper is worn, the leg cuffs may be placed in contact with the wearer's thighs, and the extent of that contact and contact pressure may be determined in part by the orientation of diaper on the body of the wearer. The leg cuffs 196 may be disposed in various ways on the diaper 102. For example, the leg cuffs 196 may be disposed on the outer, garment-facing surface 184 of the chassis 152; the inner, body-facing surface 182; or between the inner and outer facing surfaces. Leg cuffs 196 may also be referred to as leg bands, side flaps, barrier cuffs, or elastic cuffs. U.S. Pat. No. 3,860,003, which is hereby incorporated by reference herein, describes a disposable diaper that provides a contractible leg opening having a side flap and one or more elastic members to provide an elasticized leg cuff (a gasketing cuff). U.S. Pat. Nos. 4,808,178 and 4,909,803, issued to Aziz et al. on Feb. 28, 1989, and Mar. 20, 1990, respectively, which are both hereby incorporated by reference herein, describe disposable diapers having "stand-up" elasticized flaps (barrier cuffs) which improve the containment of the leg regions. U.S. Pat. Nos. 4,695,278 and 4,795,454, issued to Lawson on Sep. 22, 1987, and to Dragoo on Jan. 3, 1989, respectively, which are both hereby incorporated by reference herein, describe disposable diapers having dual cuffs, including gasketing cuffs and barrier cuffs. In some embodiments, it may be desirable to treat all or a portion of the leg cuffs with a lotion, as described above. In addition to leg cuffs, diaper can also include an elastic gasketing cuff with one or more elastic strands positioned outboard of the barrier cuff. To improve waste containment, the leg cuffs may be treated with a hydrophobic surface coating, such as described in U.S. Pat. Publication No. 20060189956A1, entitled "Hydrophobic Surface Coated Light-Weight Nonwoven Laminates for Use in Absorbent Articles," published on Aug. 24, 2006, which is hereby incorporated by reference herein.

The diaper 152 may be provided in the form of a pant-type diaper or may alternatively be provided with a re-closable fastening system, which may include fastener elements in various locations to help secure the diaper in position on the wearer. For example, fastener elements may be located on the first and second ears and may be adapted to releasably connect with one or more corresponding fastening elements located in the second waist region. It is to be appreciated that various types of fastening elements may be used with the diaper. In one example, the fastening elements include hook & loop fasteners, such as those available from 3M or Velcro Industries. In other examples, the fastening elements include adhesives and/or tap tabs, while others are configured as a macrofastener or hook (e.g., a MACRO or "button-like" fastener). Some exemplary fastening elements and systems are disclosed in U.S. Pat. No. 3,848,594, entitled "Tape Fastening System for Disposable Diaper," which issued to Buell on Nov. 19, 1974; U.S. Pat. No. B1 4,662,875, entitled "Absorbent Article," which issued to Hirotsu et al. on May 5, 1987; U.S. Pat. No. 4,846,815, entitled "Disposable Diaper Having An Improved Fastening Device," which issued to Scripps on Jul. 11, 1989; U.S. Pat. No. 4,894,060, entitled "Disposable Diaper With Improved Hook Fastener Portion," which issued to Nestegard on Jan. 16, 1990; U.S. Pat. No. 4,946,527, entitled "Pressure-Sensitive Adhesive Fastener And Method of Making Same," which issued to Battrell on Aug. 7, 1990; and U.S. Pat. No. 5,151,092, issued to Buell on Sep. 29, 1992; and U.S. Pat. No. 5,221,274, which issued to Buell on Jun. 22, 1993, which are all hereby incorporated by reference herein. Additional examples of fasteners and/or fastening elements are discussed in U.S. Pat. Nos. 6,251,097 and 6,432,098; U.S. patent application Ser. No. 11/240,943, entitled, "Anti-Pop Open Macrofasteners" filed on Sep. 30, 2005; and U.S. patent application Ser. No. 11/240,838, entitled, "A Fastening System Having Multiple Engagement Orientations", filed on Sep. 30, 2005, which are all hereby incorporated by reference herein. Other fastening systems are described in more detail in U.S. Pat. No. 5,595,567 issued to King et al. on Jan. 21, 1997 and U.S. Pat. No. 5,624,427 issued to Bergman et al. on Apr. 29, 1997, both of which are entitled "Nonwoven Female Component For Refastenable Fastening Device." Yet other fastening systems are described in U.S. Pat. Nos. 5,735,840 and 5,928,212, both of which issued to Kline et al. and are entitled "Disposable Diaper With Integral Backsheet Landing Zone," which are both hereby incorporated by reference herein. The fastening system may also provide a means for holding the article in a disposal configuration as disclosed in U.S. Pat. No. 4,963,140, which issued to Robertson et al. on Oct. 16, 1990, which is hereby incorporated by reference herein.

It is to be appreciated that the methods and apparatuses disclosed herein may be utilized to support and/or align vision systems configured to monitor and/or view the quality of substrates and components as well as relative placement during the manufacture of absorbent articles, such as for example, topsheets, backsheets, absorbent cores, ears, waist features, and graphics printed thereon.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus for supporting imaging equipment comprising:

a main support member comprising:

a base member having a first end portion and a second end portion;

a first member having a proximal end portion and a distal end portion, wherein the proximal end portion is connected with the first end portion of the base member, wherein the first member is adapted to support a light source;

a second member having a proximal end portion and a distal end portion, wherein the proximal end portion is connected with the second end portion of the base member; wherein the distal end portion of the second member is adapted to support a camera; and an alignment member having a first end portion and a second end portion, wherein the first end portion is releasably connectable with the distal end portion of the first member and wherein the second end portion is releasably connectable with the base member, and wherein the alignment member includes at least one slot substantially parallel to the first member; and wherein the distal end portion of the second member comprises a support plate adapted to support the camera, wherein the support plate can be selectively moved in at least two directions relative to the alignment member.

2. The apparatus of claim 1, wherein the distal end portion of the second member includes an aperture adapted to receive a portion of the camera.

3. The apparatus of claim 1, wherein the alignment member includes a channel defining an area of reduced thickness.

4. The apparatus of claim 3, wherein the at least one slot is positioned in the channel.

5. The apparatus of claim 1, wherein the at least one slot comprises four slots separated by three bridges, defining two inner slots and two outer slots.

6. The apparatus of claim 5, wherein the two inner slots are longer than the two inner slots.

7. The apparatus of claim 1, wherein the base member, first member, and second member are integrally formed as single piece of material.

8. A method for supporting and aligning imaging equipment on a web converting line comprising the steps of:

positioning a main support member to a fixture adjacent a substrate configured to advance in a machine direction, wherein the main support member comprises: a base member having a first end portion and a second end portion; a first member having a proximal end portion and a distal end portion, wherein the proximal end portion is connected with the first end portion of the base member; and a second member having a proximal end portion and a distal end portion, wherein the proximal end portion is connected with the second end portion of the base member;

supporting a light source with the distal end portion of the first member and supporting a camera with the distal end portion of the second member, wherein the camera is positioned to view a substrate advancing in a machine direction between the first member and the second member and wherein the light source is positioned to extend in a cross direction adjacent the substrate;

connecting an alignment member with the distal end portion of the first member and the base member, wherein the alignment member includes at least one slot; and directing light from the light source through the at least one slot toward the camera.

9. The method of claim 8, wherein the distal end portion of the second member includes an aperture adapted to receive a portion of the camera.

10. The method of claim 8, wherein the alignment member includes a channel defining an area of reduced thickness.

11. The method of claim 10, wherein the at least one slot is positioned in the channel.

12. The method of claim 8, wherein the at least one slot comprises four slots separated by three bridges, defining two inner slots and two outer slots.

13. The method of claim 12, wherein the two inner slots are longer than the two inner slots.

14. The method of claim 8, wherein the distal end portion of the second member comprises a support plate adapted to support the camera, wherein the support plate can be selectively moved in at least two directions relative to the alignment member.

15. The method of claim 8, wherein the base member, first member, and second member are integrally formed as single piece of material.

16. An apparatus for supporting imaging equipment adapted to view an object comprising:

a main support member comprising:

a base member having a first end portion, a second end portion, and a mid portion between the first and second end portions;

a first member having a proximal end portion and a distal end portion, wherein the proximal end portion is connected with the base member;

a second member having a proximal end portion and a distal end portion, wherein the proximal end portion is connected with the second end portion of the base member;

a light source connected with the first member; and a camera connected with the second member.

17. The apparatus of claim 16, wherein the first member is connected with the mid portion of the base member and wherein the camera is positioned to view a side of the object and the light source is positioned to direct light onto the side of the object viewed by the camera.

18. The apparatus of claim 16, wherein the first member is connected with the first end portion of the base member and wherein the camera is positioned to view a first side of the object and the light source is positioned to direct light onto a second side of the object disposed opposite the first side viewed by the camera.

19. The apparatus of claim 16, further comprising: an alignment member having a first end portion and a second end portion, wherein the first end portion is releasably connectable with the main support member, and wherein the alignment member includes at least one slot.

* * * * *